US005211507A

United States Patent [19]

Siseki et al.

[11] Patent Number: 5,211,507

[45] Date of Patent: May 18, 1993

[54] METHOD OF MAKING A HUGE ELONGATED SPACE OF SQUARE OR RECTANGULAR CROSS SECTION UNDER THE GROUND

[75] Inventors: Ayao Siseki; Koji Tada; Toru Taniguchi; Masahiro Nakagawa; Yuji Tachikawa; Makoto Ukegawa, all of Tokyo, Japan

[73] Assignees: Toda Corporation; Mitsui Engineering & Shipbuilding Co. Ltd., both of Tokyo, Japan

[21] Appl. No.: 862,944

[22] Filed: Apr. 3, 1992

[30] Foreign Application Priority Data

Apr. 5, 1991 [JP] Japan ..... 3-099803
Apr. 5, 1991 [JP] Japan ..... 3-099804
Apr. 5, 1991 [JP] Japan ..... 3-099805

[51] Int. Cl.[5] ..... E21D 9/00

[52] U.S. Cl. ..... 405/138; 405/146; 405/150.1

[58] Field of Search ..... 405/132, 138, 139, 146, 405/150.1

[56] References Cited

U.S. PATENT DOCUMENTS 3,631,680 1/1972 Thomson ..... 405/139
3,916,630 11/1975 Arsuaga ..... 405/139
3,968,655 7/1976 McGlothlin ..... 405/139
4,147,452 4/1979 Ogasawara et al. ..... 405/139 X
4,166,509 9/1979 Ueno et al. ..... 405/139 X

*Primary Examiner*—David H. Corbin
*Attorney, Agent, or Firm*—Nikaido, Marmelstein, Murray & Oram

[57] ABSTRACT

Disclosed is a method of making a huge elongated space of square or rectangular cross section under the ground. The outer shell of the huge elongated space is built in the form of integral arrangement of lateral shell-units having shielded passages therein. Such a huge underground space can be made without requiring any large-scale equipments on the ground. The huge outer shell can be made with accuracy and efficiency by skiving and jointing adjacent parallel lateral shell-units and by using selected lateral passage of shell-units to discharge the soil or mud removed in making the underground space.

6 Claims, 14 Drawing Sheets

METHOD OF MAKING A HUGE ELONGATED SPACE OF SQUARE OR RECTANGULAR CROSS SECTION UNDER THE GROUND

BACKGROUND OF THE INVENTION

1. Field of the Invention

The present invention relates to a method of making a huge underground space whose size is comparable to a town or city space.

2. Description of Related Art

Japanese Patent 3-39,600(A) shows a method of making such a huge underground space, which is illustrated in FIG. 19. FIG. 20 shows the manner in which a huge underground space is made. First, two longitudinal holes (not shown) are made at an elongated interval in the earth. A shield driving machine M is driven in one direction from one longitudinal hole to the other longitudinal hole to make one lateral sector shell-unit S having passage P therein extending between the opposite longitudinal holes. Then, the shield driving machine M is driven in the other direction from the other longitudinal hole to the one longitudinal hole to make another lateral sector shell-unit S running adjoiningly and parallel to the first lateral shell-unit. This lateral shell-unit making process is repeated until a plurality of lateral shell-units are continuously arranged on the circumference of a huge circle, thus forming the outer shell of the huge underground space. Then, the lateral shell-unit making process is repeated until a plurality of lateral shell-units are continuously arranged on a horizontal chord. By using power shovels the soil is removed from the major and minor segments of the huge circle which are delimited by the outer shell.

Accurate arrangement of a plurality of lateral shell-units on the circumference of huge circle is very difficult. Minor positioning errors are likely to be accumulated to prevent both ends of the open loop from meeting together at the final stage. Workers in adjacent lateral passages make reinforced concrete structures to connect adjacent lateral shell-units. This requires much laborious work and cost.

SUMMARY OF THE INVENTION

In view of the above the object of the present invention is to provide a method of making such a huge underground space with ease and efficiency.

To attain this object a first method of making a huge elongated space of square or rectangular cross section under the ground according to the present invention comprises the steps of: making at least two longitudinal holes at an elongated interval in the earth; making a plurality of first lateral square or rectangular shell-units having shielded passages therein extending between the longitudinal holes and arranged at regular intervals on the four sides of a square or rectangular shape corresponding to the square or rectangular cross section of the huge elongated space; making a plurality of second lateral square or rectangular shell-units having shielded passages extending between the longitudinal holes and arranged on the four sides of the square or rectangular shape for each second lateral square or rectangular shell-unit to occupy the interval and connect adjacent first lateral square or rectangular shell-units to form a continuous huge square or rectangular elongated outer-shell; and removing the soil from the square or rectangular area delimited by the huge outer shell to leave the huge elongated space extending between the longitudinal holes.

Two or more parallel-connected shield driving machines each having a same size and square or rectangular shape, may be used to make each of the first and second lateral square or rectangular shell-units.

A second method of making a huge elongated space of square or rectangular cross section under the ground according to the present invention comprises the steps of: making at least two longitudinal holes at an elongated interval in the earth; making a plurality of first lateral square or rectangular shell-units having shielded passages extending between the longitudinal holes and arranged at intervals on the four sides of a square or rectangular shape corresponding to the square or rectangular cross section of the huge elongated space; making a plurality of second lateral square or rectangular shell-units having shielded passages extending between the longitudinal holes and arranged on the four sides of the square or rectangular shape so as to position each second lateral shell-unit between adjacent first lateral shell-units, leaving soil between the first and second lateral shell-units; forming reinforced concrete structures to connect adjacent first and second lateral shell-units to form a continuous huge square or rectangular elongated outer-shell; and removing the soil from the square or rectangular area delimited by the outer shell thus connected to leave the huge elongated space extending between the longitudinal holes.

Two or more parallel-connected shield driving machines each having a different size and square or rectangular shape, may be used to make each of the first and second lateral square or rectangular shell-units.

Other objects and advantages of the present invention will be understood from the following description of preferred embodiments of the first and second methods of the present invention, which are illustrated in accompanying drawings:

DESCRIPTION OF THE PREFERRED EMBODIMENTS

Figure 1A:
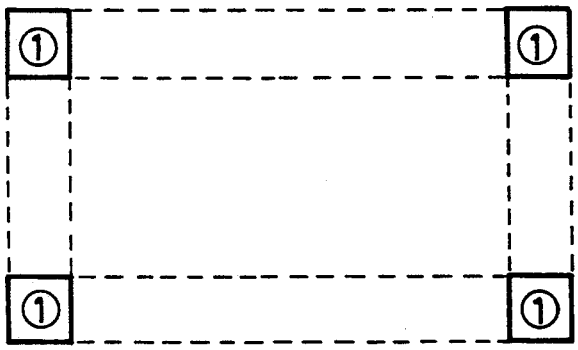
FIGS. 1A to 1F show the manner in which first and second lateral square shell-units are made according to the first method.
Figure 1B:
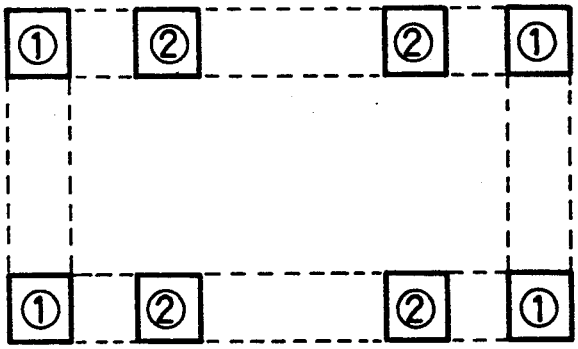
Figure 1C:
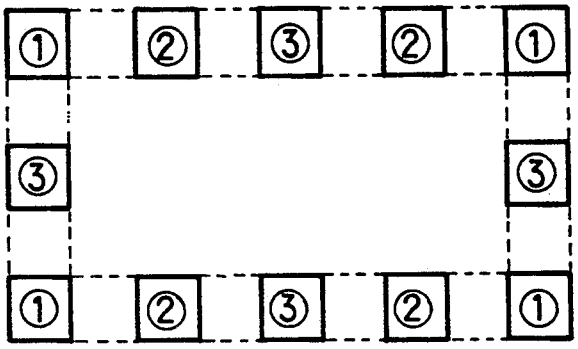
Figure 1D:
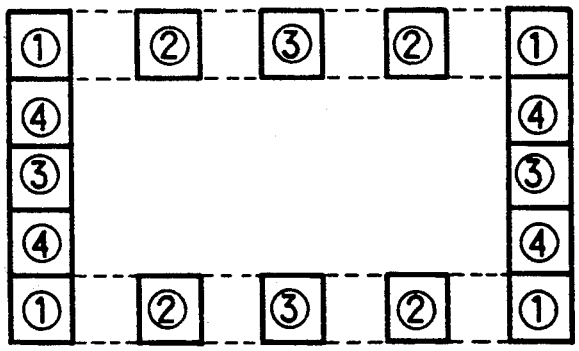
Figure 1E:
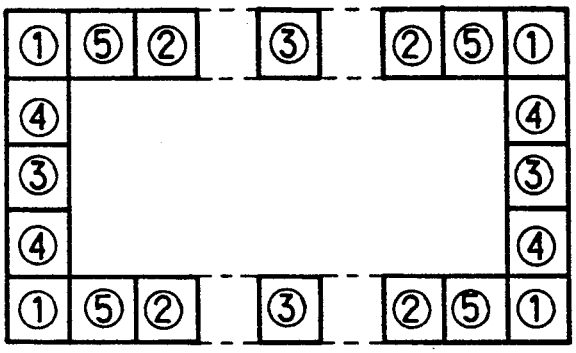
Figure 1F:
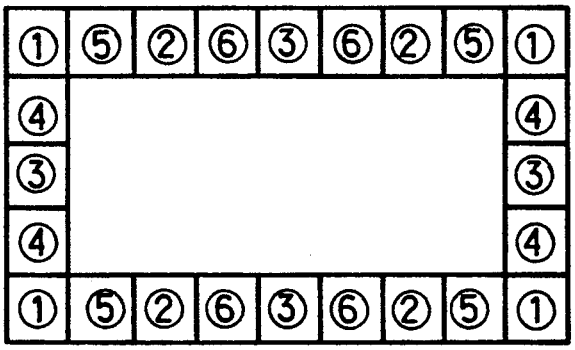

Referring to FIGS. 1 to 10, there is shown a method of making a huge elongated space of rectangular cross section under the ground according to the invention. First, two longitudinal holes 1 and 2 (FIG. 6) are made at an elongated interval in the earth. A plurality of first lateral square shell-units 1, 2 and 3 (FIG. 1C) each forming a shielded passage therein are made at regular intervals on the four sides of a rectangular shape (broken lines) corresponding to the rectangular cross section of the huge elongated space to be made. Specifically, first, four square shield driving machines (FIGS. 8, 9 and 10) are driven from one longitudinal hole 1 to the other longitudinal hole 2 in one direction (hereinafter referred to as the "proximal-to-distal end direction") to make four lateral shell-units 1, 1, 1 and 1 at the four corners of the huge rectangular shell shape (FIG. 1A). Second, these four shield driving machines are driven from the other longitudinal hole 2 to the one longitudinal hole 1 in the other or opposite direction (hereinafter referred to as the "distal-to-proximal end direction") to make four lateral shell-units 2, 2, 2 and 2 apart from each corner square shell-units 1, 1, 1 and 1 by the distance of one side of the square unitary hole (FIG. 1B). Third, the four shield driving machines are driven in the "proximal-to-distal end direction" to make four lateral shell-units 3, 3, 3 and 3 apart from each of the four corner square shell-units 1 and each of the four square shell-units 2 by the distance of one side of the unitary square hole (FIG. 1C). Fourth, the four shield driving machines are driven in the "distal-to-proximal end direction" to make four lateral shielded square shell-units 4, 4, 4 and 4 to connect each of the corner square shell-units 1, 1, 1 and 1 and the intermediate lateral shell-unit 3, thus making up two opposite vertical stretches (FIG. 1D). Fifth, the four shield driving machines are driven in the "proximal-to-distal end direction" to make four lateral shell-units 5, 5, 5 and 5 to connect each of the corner shell-units 1, 1, 1 and 1 and the lateral shell-units 2, 2, 2 and 2 (FIG. 1E). Finally, the four shield driving machines are driven in the "distal-to-proximal end direction" to make four lateral shell-units 6, 6, 6 and 6 to connect the lateral shell-units 2, 2, 2 and 2 and 3, 3, 3 and 3, thus making up upper and lower horizontal stretches (FIG. 1F). These lateral shell-units 1 to 6 run parallel from one longitudinal hole 1 to the other longitudinal hole 2 under the ground to make up the outer shell of the huge underground space.

Figure 2:
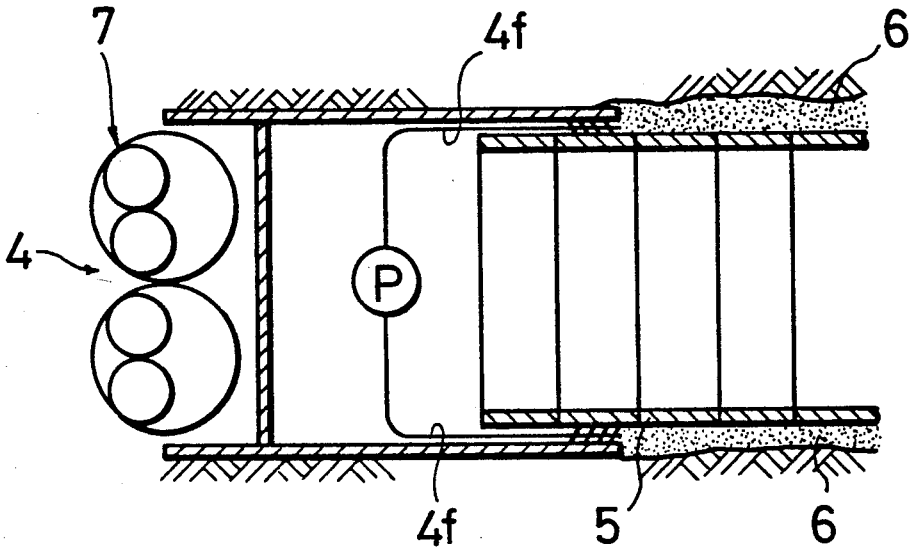
FIG. 2 shows, in section, the manner in which a shield driving machine is making a lateral square shell-unit having a shielded passage.
Figure 3:
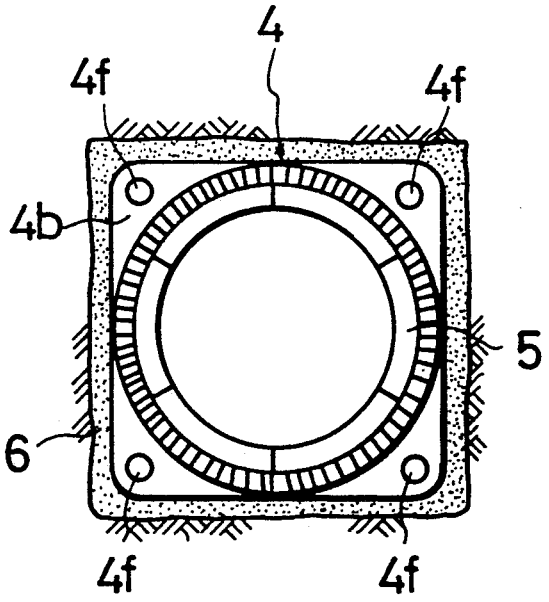
FIG. 3 shows the lateral shell-unit as viewed from the right end of FIG. 2.
Figure 4:
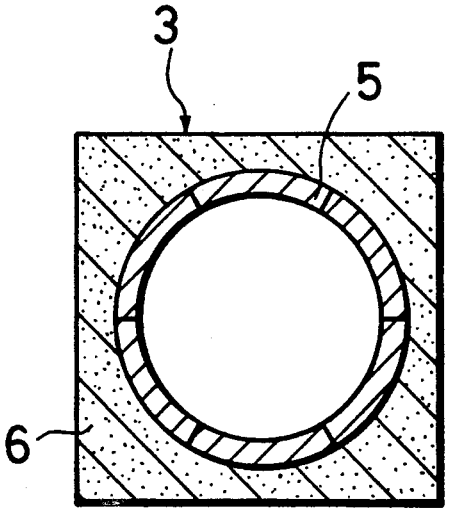
FIG. 4 is a cross section of the lateral shell-unit.

Referring to FIGS. 2, 3 and 4, a shield driving machine 4 which is described later in detail, makes a lateral hole, starting from one longitudinal hole and advancing towards the other longitudinal hole. As seen from FIG. 2, the shield driving machine 4 rotates its front cutters 7 to remove the soil in front of the machine, pushing the removed soil behind. Steel or concrete sector segments 5 as lining material are brought in the hole thus made, and these sector segments 5 are arranged to form an inner circular shell. An associated pump P is used to feed filler or grout such as formed mortar or concrete via its feeding pipes 4*f* into the circumferential space between the inner circular shell and the lateral hole, as indicated at 6 to make a square lateral shell-unit 3 as seen in FIG. 4.

Figure 5:
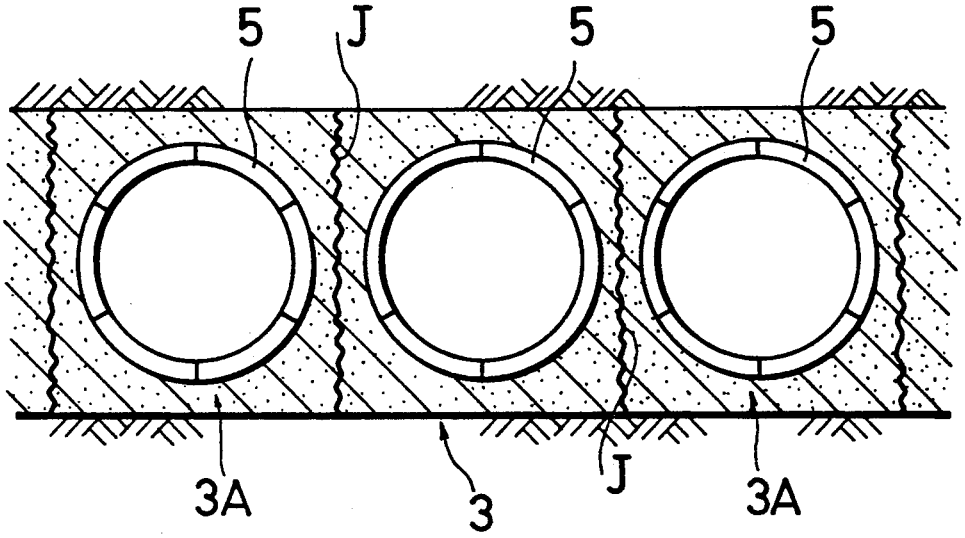
FIG. 5 shows the manner in which first and second lateral shell-units are integrally connected to each other to make up a horizontal stretch of the huge space.

Referring to FIG. 5, a lateral shell-units 3 having shielded passage therein is made so as to integrally connected to adjacent lateral shell-units 3A, 3B. Specifically, a shield driving machine is made to advance, thus making a lateral hole, and at the same time cutting and scraping the side surface of the filler of each of the opposite shell-units 4, thus exposing the fresh jagged mortar or concrete surface over the side of each shell-units 3A and 3B. Steel or concrete sector segments 5 are brought in the hole thus made, and these sector segments 5 are arranged to form an inner circular shell, as described earlier.

When the circumferential space between the inner shell and the lateral hole is filled with filler such as formed mortar or concrete, the adjacent lateral shell-units are integrally connected together at the joints, which are made by allowing mortar to coat on the extensive fresh jagged mortar or concrete surface of the opposite shell-units 3A, 3B. Thus, integral connection of parallel lateral shell-units result. Use of expanded mortar or concrete as filler makes it easy for a shield driving machine to cut and scrape the side surface of the shell-units. In this particular embodiment, circular segments to form inner shells are used, but inner shells may be of a square or rectangular shape or of any other desired shape.

Figure 6:
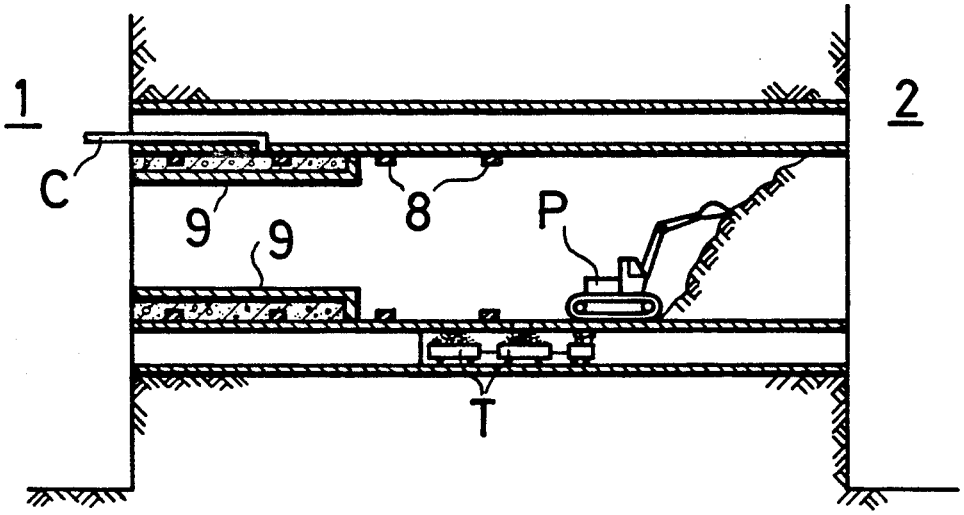
FIG. 6 shows the manner in which the soil is removed from the rectangular area delimited by the upper and lower horizontal stretches and the opposite vertical stretches to leave a huge elongated space extending between the opposite longitudinal holes.
Figure 7:
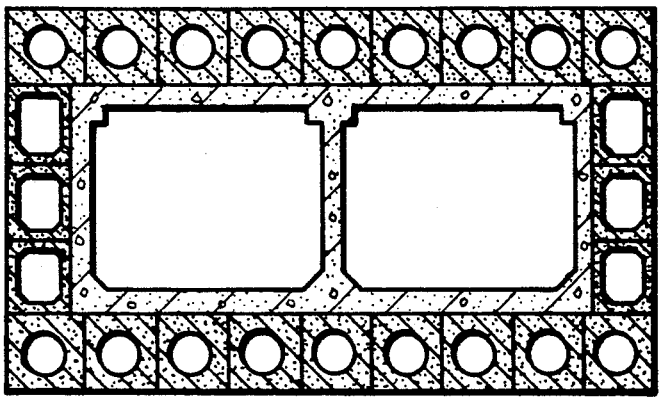
FIG. 7 is a cross section of the huge elongated space thus made.

As shown in FIG. 6, power shovels P remove the soil from the rectangular area delimited by the upper and lower horizontal and opposite vertical stretches of lateral shell-units to leave the huge elongated space extending between the longitudinal holes 1 and 2. Beams 8 are fixed to the ceiling of the outer shell at predetermined intervals to support the weight of the horizontal stretches. Frames 9 are made, and concrete is fed via feeding pipes C into the space in the frame 9. Selected lateral passages of shell-units and trucks T may be used to carry out the soil or mud removed by power shovels P. FIG. 7 shows, in cross section, the underground space delimited by the continuous outer shell made of horizontal and vertical integral arrangement of lateral shell-units.

Figure 8:
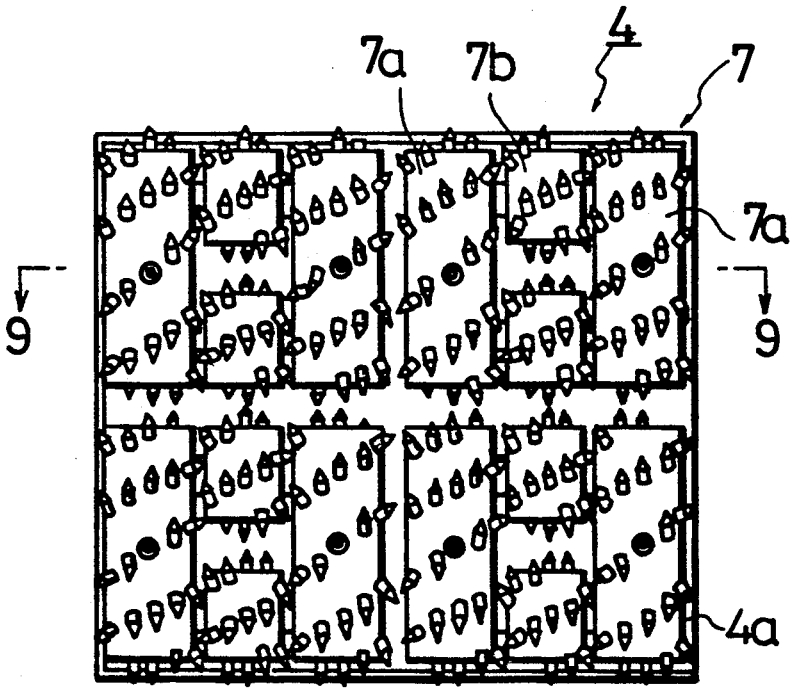
FIG. 8 is a front view of a square shield driving machine.
Figure 9:
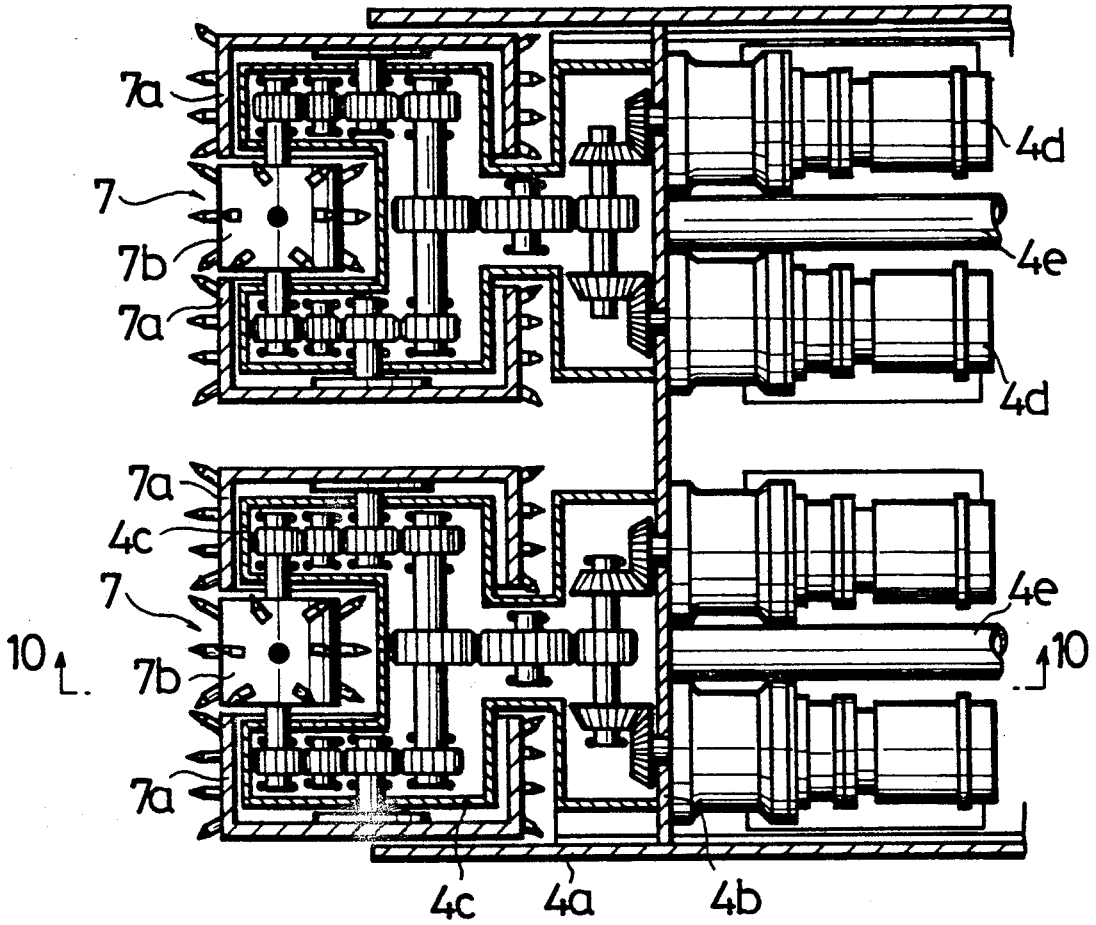
FIG. 9 is a section taken along the line 9—9 in FIG. 8.
Figure 10:
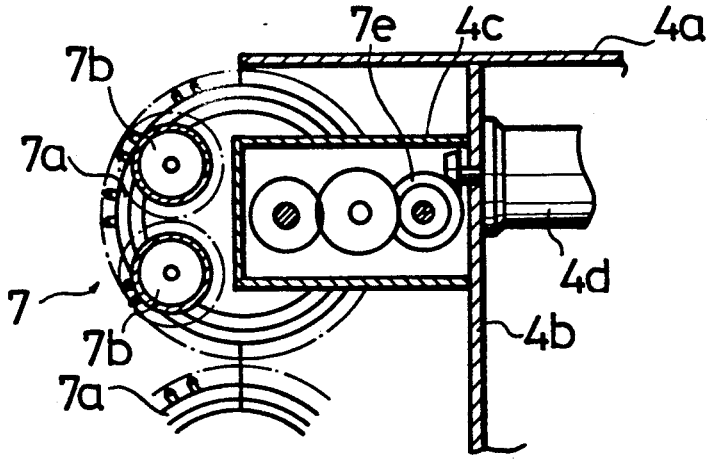
FIG. 10 is a section taken along the line 10—10 in FIG. 9.

Referring to FIGS. 8, 9 and 10, a shield-driving machine 4 is shown as comprising, in combination, four square-shaped cutters 7 each consisting of two opposite rotary drum cutters 7*a* and 7*a* and upper and lower rotary ring cutters 7*b* and 7*b* between the opposite rotary drum cutters (FIG. 8).

As shown in FIG. 9, the shield-driving machine 4 has four motors 4*d* and associated ganged gearings. Driving power can be transmitted from the motors 4*d* to the square-shaped cutters 7 via the ganged gearings, which can rotate the rotary drum cutters 7*a* and 7*a* and the upper and lower rotary ring cutters 7*b* and 7*b* in same direction. These ganged gearings are contained in a gear box 4*c*. The gear box 4*b* is attached to a transverse wall 4*b*, which divides the space of casing 4*a* into the motor compartment and the gearing compartment. Mud discharging conduits 4*e* extend backward below from the drum cutters 7*a*.

In this particular embodiment four shield-driving machines 4 are used. It, however, should be understood that an appropriate number of machines may be used in consideration of the size of the underground space to be made, and that shield-driving machines of different shapes and sizes may be combined when occasions demand.

Figure 11A:
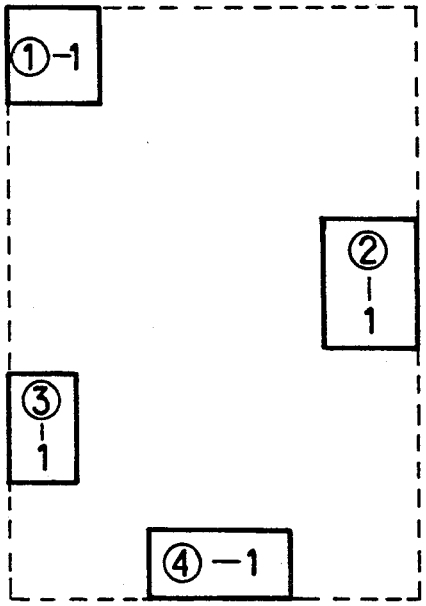
FIGS. 11A to 11D show the manner in which first and second lateral rectangular shell-units are made according to the second method.
Figure 11B:
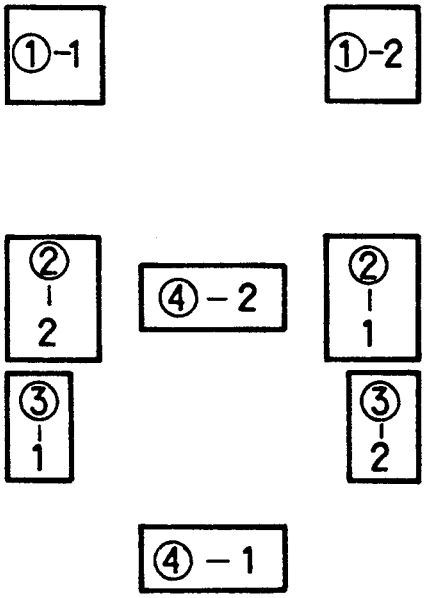
Figure 11C:
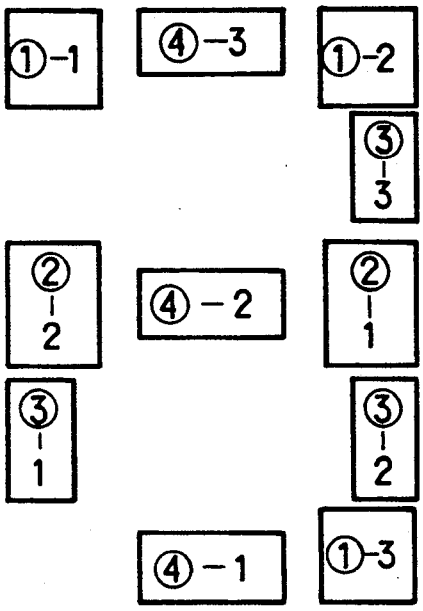
Figure 11D:
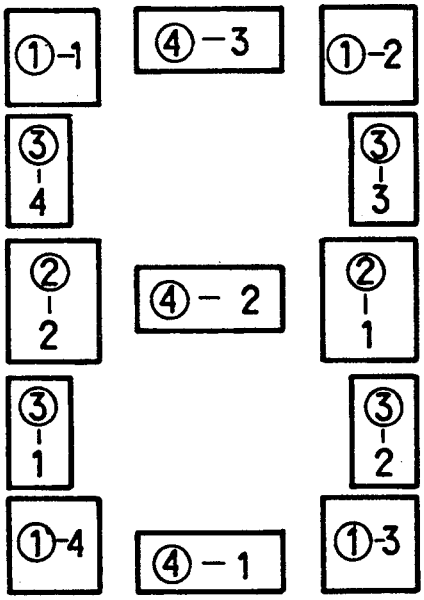
Figure 12:
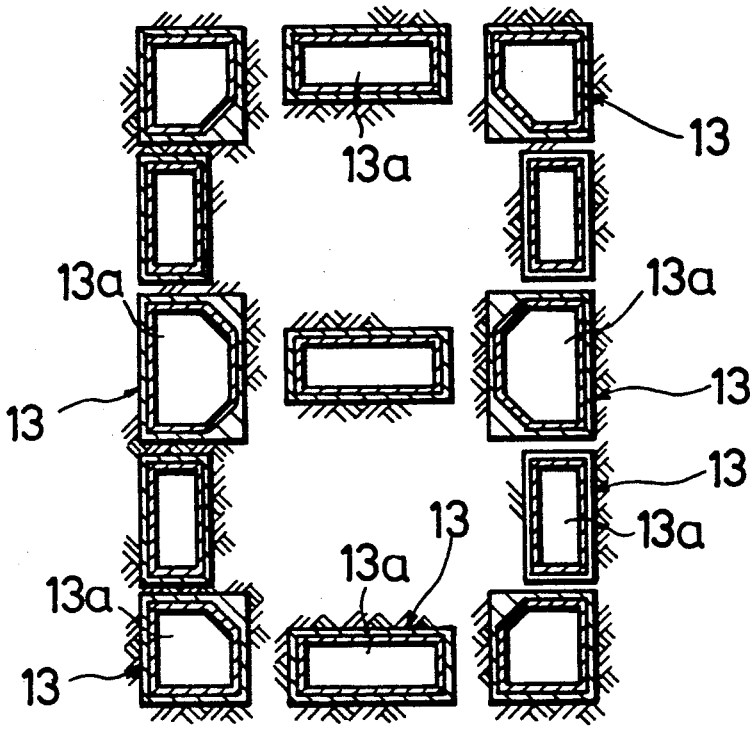
FIG. 12 shows the vertical-and-horizontal arrangement of first and second lateral shell-units, leaving different intervals between adjacent shell-units.

Referring to FIGS. 11A to 11D, there is shown another method of making a huge elongated space of rectangular cross section under the ground according to the invention. First, two longitudinal holes 11 and 12 (FIG. 18) are made at an elongated interval in the earth. A plurality of first lateral square and rectangular shell-units (FIG. 11D) are made at different intervals on the four sides and one intermediate bridge of a rectangular shape corresponding to the rectangular cross section of the huge elongated space which is to be made. Specifically, first, four shield driving machines of different square or rectangular sizes are moved from one longitudinal hole 11 to the other longitudinal hole 12 in one direction (hereinafter referred to as the "proximal-to-distal end direction") to make four lateral square and rectangular shell-units ①-1, ②-1, ③-1 and ④-1 on selected three sides of the presumed huge rectangular shell shape (broken line in FIG. 11A). Second, these four shield driving machines are driven from the other longitudinal hole 12 to the one longitudinal hole 11 in the other or opposite direction (hereinafter referred to as the "distal-to-proximal end direction") to make four lateral shell-units ①-2, ②-2, ③-2 and ④-2 as shown in FIG. 11B. Third, selected three of the four shield driving machines are driven in the "proximal-to-distal end direction" to make three lateral shell-units ①-3, ③-3 and ④-3 (FIG. 11C). Finally, selected two of the three shield driving machines are driven in the "distal-to-proximal end direction" to make two lateral shell-units ①-4 and ③-4 (FIG. 11D). Thus, a two-story formation of lateral shell-units results as seen from FIG. 12.

Figure 13:
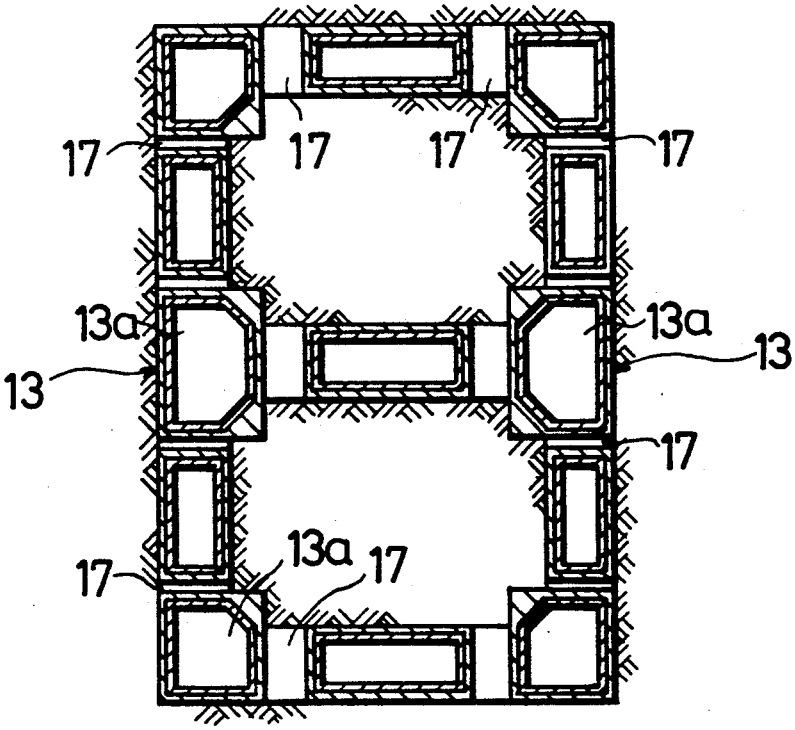
FIG. 13 is a similar view to FIG. 12, but showing an interspace between adjacent shell-units.
Figure 14:
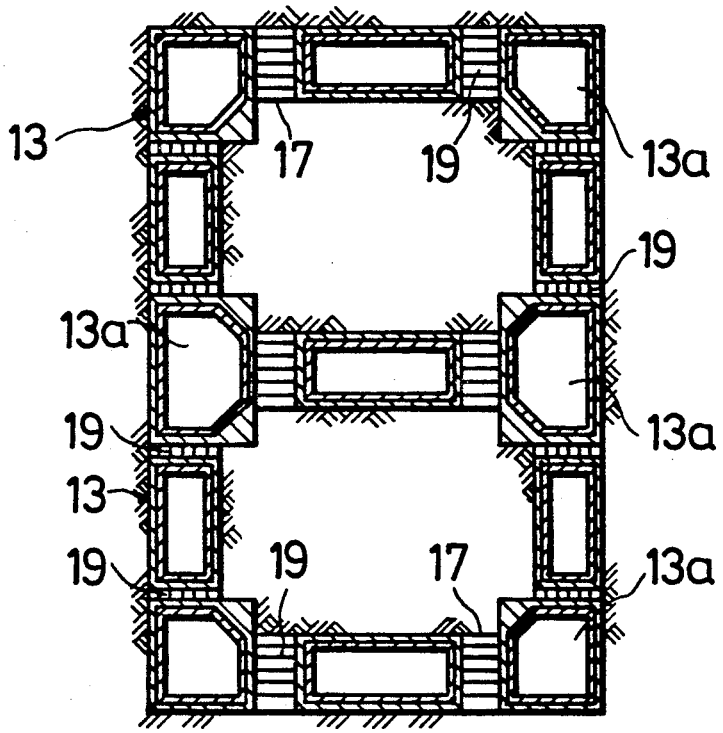
FIG. 14 is a similar view to FIG. 13, but showing reinforced steel bars to connect adjacent shell-units.
Figure 15:
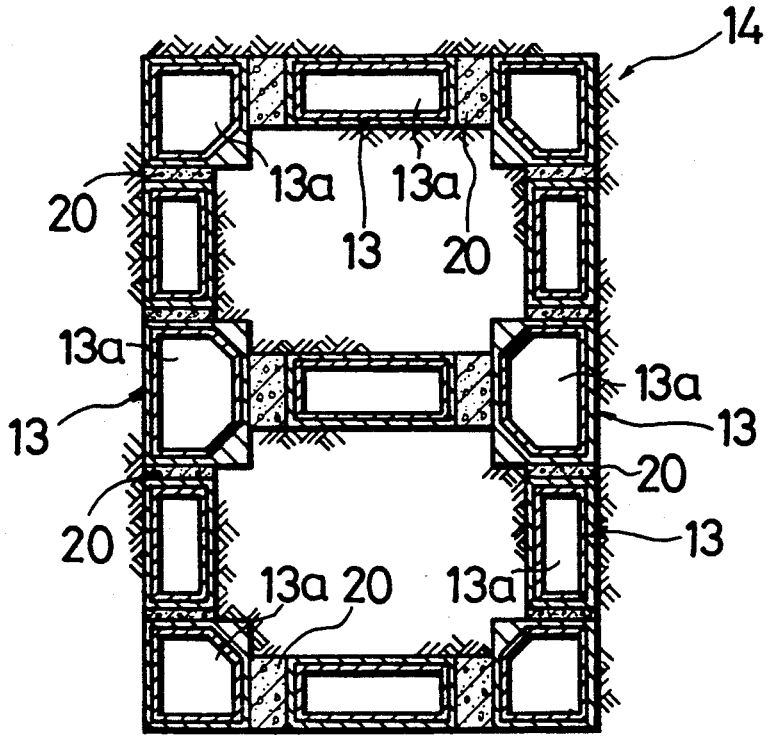
FIG. 15 is a similar view to FIG. 14, but showing a reinforced-concrete structure to connect adjacent shell-units.
Figure 16:
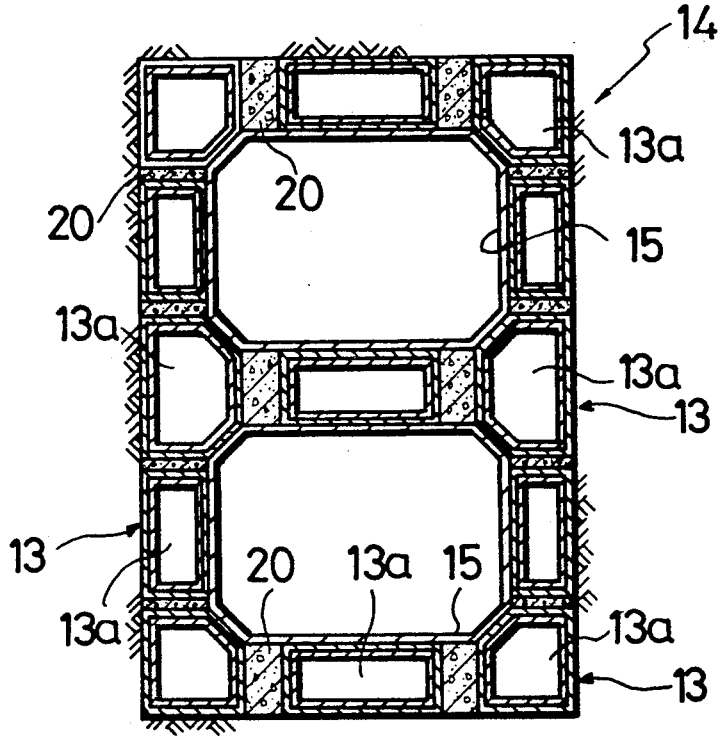
FIG. 16 is a similar view to FIG. 15, but showing the upper and lower spaces in place of soil with the projecting corners of selected lateral shell-unit structures removed.

Thereafter, a bridging hole 17 is made between adjacent lateral square shell-units 13 and 13 by making holes on the side walls of each of the adjacent lateral passages 13*a* and 13*a* and removing soil, as shown in FIG. 13. A plurality of reinforced steel bars 19 extend across each bridging hole 17 (FIG. 14), and the bridging hole 17 is filled with concrete 20 (FIG. 15). Thus, all lateral shell-units 13 are integrally connected together to form continuous outer shell 14. Then, the soil is removed from each of the upper and lower rectangular areas 15, and the projecting corners of the shell structure are removed.

Figure 17:
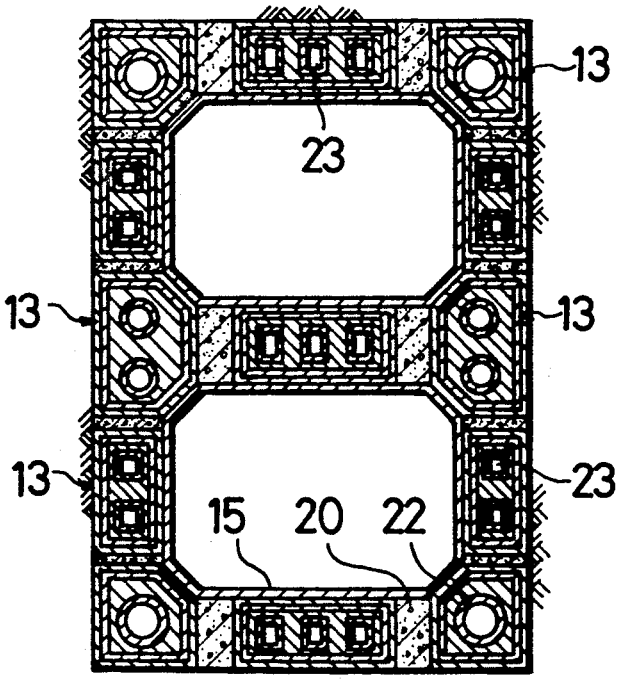
FIG. 17 is a similar view to FIG. 16, but showing the shielded passages of shell-units filled with pipings, ducts and other necessary equipments.
Figure 18:
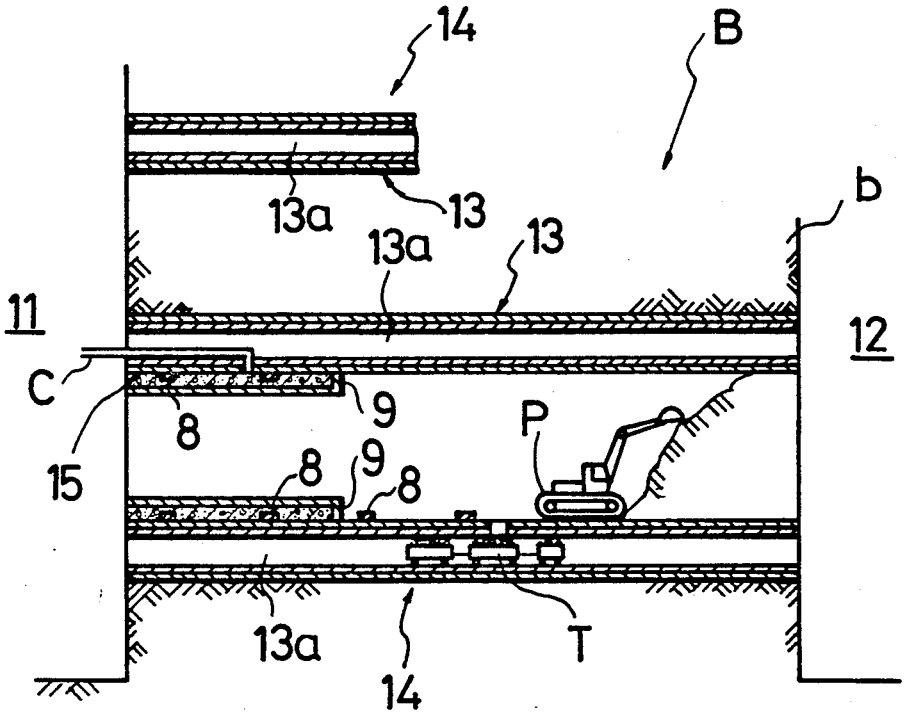
FIG. 18 shows the manner in which the soil is removed from the lower rectangular area delimited by the intermediate and lower horizontal stretches and the opposite vertical stretches to leave a huge elongated space extending between the opposite longitudinal holes.
Figure 19:
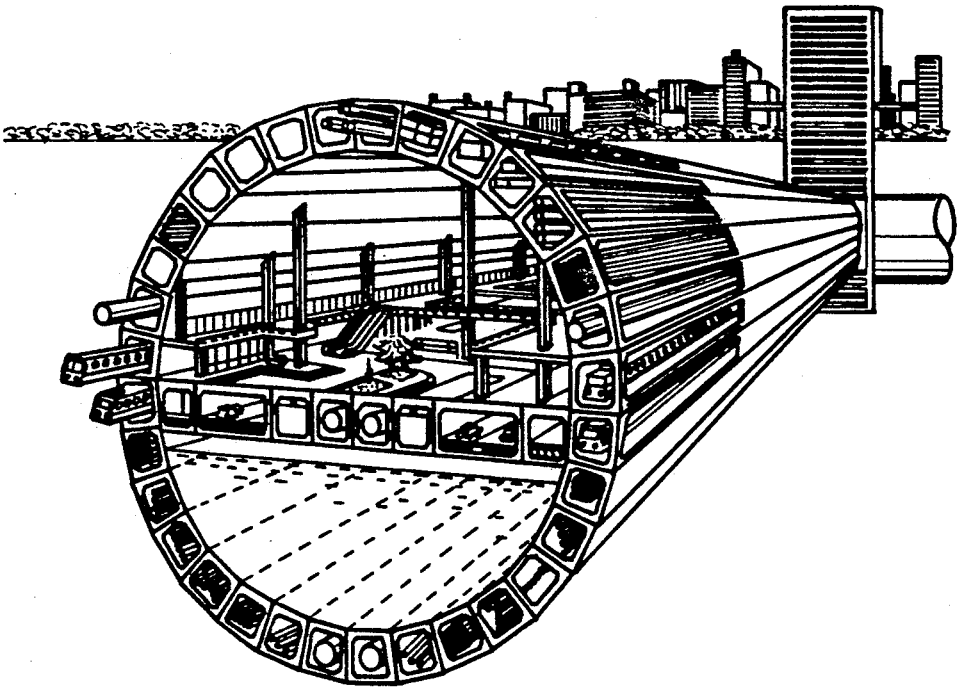
FIG. 19 PRIOR ART
FIG. 19 is a perspective view of a huge elongated space under the ground.
Figure 20:
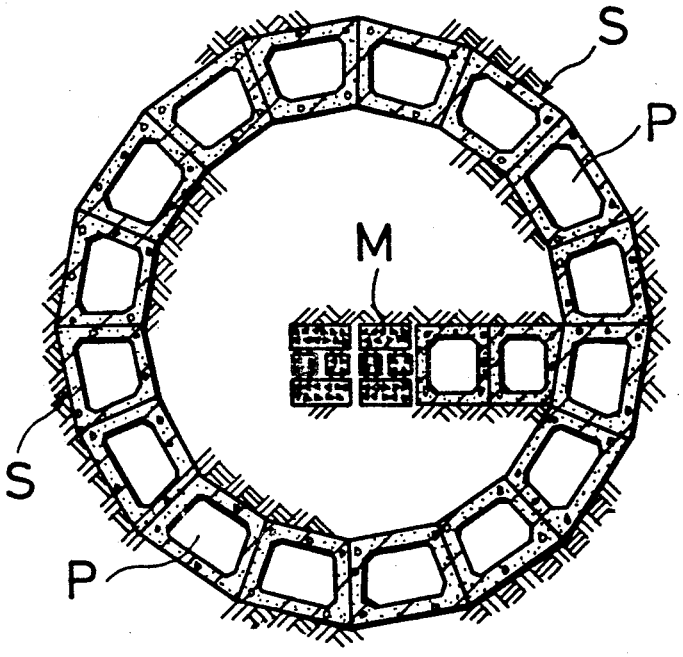
FIG. 20 PRIOR ART
FIG. 20 shows the manner in which such a huge underground space is made according to a conventional method.

As shown in FIG. 18, power shovels P remove the soil or mud from the rectangular area delimited by the intermediate and lower horizontal and opposite vertical stretches to leave a huge elongated space between the longitudinal holes 11 and 12. Beams 8 are fixed to the intermediate horizontal stretch at predetermined intervals to support its weight. Frames 9 are made, and concrete is fed via feeding pipes C into the space in the frame 9. Selected lateral passages 13*a* of shell units 13 and trucks T may be used to carry out the soil or mud removed by power shovels P. In the same way the soil or mud is removed from the area delimited by the intermediate and upper horizontal stretches and by the opposite vertical stretches to leave a hugh elongated space between the longitudinal holes 11 and 12. FIG. 17 shows, in cross section, the underground space delimited horizontal and vertical integral-arrangement of lateral shell-units, which are equipped with pipings 22, air ducts 23 and other necessary equipments.

As may be understood from the above, underground towns can be built without requiring any large-scale equipments on the ground. The huge outer shell can be made with accuracy and efficiency by skiving and jointing adjacent parallel lateral shell-units and by using selected lateral pasages formed in the shell-units to discharge the soil or mud removed in making the underground space.

We claim:

1. A method of making a huge elongated space of square or rectangular cross section under the ground comprising the steps of:

making at least two longitudinal holes at an elongated interval in the earth;

making a plurality of first lateral square or rectangular shell-units at different depths in the ground having shielded passages therein extending between said longitudinal holes and arranged at regular intervals on four sides of a square or rectangular shape corresponding to a square or rectangular cross section of said huge elongated space;

making a plurality of second lateral square or rectangular shell-units at different depths in the ground having shielded passages extending between said longitudinal holes and arranged on the four sides of said square or rectangular shape for each second lateral square or rectangular shell-unit to occupy the interval and connect adjacent first lateral square or rectangular shell-units to form a continuous square or rectangular huge elongated outer-shell; and removing the soil from the square or rectangular area delimited by said huge outer shell to leave the huge elongated space extending between said longitudinal holes.

2. A method of making a huge elongated space of square or rectangular cross section under the ground claimed in claim 1, wherein two or more parallel-connected shield driving machines each having a same size and square or rectangular shape, are used to make each of said first and second lateral square or rectangular shielded passages.

3. A method of making a huge elongated space underground according to claim 1 further comprising the steps of forming said first lateral shell-units having mortar or concrete side surfaces and forming said second lateral shell-units by cutting, scraping and exposing said side surfaces of adjacent first lateral shell-units, and integrally connecting said second lateral shell-units to said side surfaces of said first lateral shell-units.

4. A method of making a huge elongated space of square or rectangular cross section under the ground comprising the steps of:

making at least two longitudinal holes at an elongated interval in the earth;

making a plurality of first lateral square or rectangular shell-units at different depths in the ground having shilded passages extending between said longitudinal holes and arranged at intervals on four sides of a square or rectangular shape corresponding to a square or rectangular cross section of said huge elongated space;

making a plurality of second lateral square or rectangular shell-units at different depths in the ground having shielded passages extending between said longitudinal holes and arranged on the four sides of said square or rectangular shape so as to position each second lateral shell-unit between adjacent first lateral shell-units, leaving soil between said first and second lateral shell-units;

forming reinforced concrete structures to connect adjacent first and second lateral shell-units to form a continuous huge square or rectangular elongated outer-shell; and removing the soil from the square or rectangular area delimited by said outer shell thus connected to leave the huge elongated space extending between said longitudinal holes.

5. A method of making a huge elongated space of square or rectangular cross section under the ground claimed in claim 4, wherein two or more parallel-connected shield driving machines each having a different size and square or rectangular shape, may be used to make each of said first and second lateral square or rectangular shell-units.

6. A method of making a huge elongated space underground according to claim 4 further comprising the steps of forming said first lateral shell-units having mortar or concrete side surfaces and forming said second lateral shell-units by cutting, scraping and exposing said side surfaces of adjacent first lateral shell-units, and integrally connecting said second lateral shell-units to said side surfaces of said first lateral shell-units.

* * * * *